US010606293B2

(12) United States Patent
Iroaga et al.

(10) Patent No.: US 10,606,293 B2
(45) Date of Patent: Mar. 31, 2020

(54) ON-CHIP VOLTAGE REGULATOR PROVIDING EXTENDED RANGE OF VOLTAGE SUPPLIES

(71) Applicant: MACOM Technology Solutions Holding, Inc., Lowell, MA (US)

(72) Inventors: Echere Iroaga, Mountain View, CA (US); Nanda Govind Jayaraman, Santa Clara, CA (US)

(73) Assignee: MACOM Technology Solutions Holdings, Inc., Lowell, MA (US)

( * ) Notice: Subject to any disclaimer, the term of this patent is extended or adjusted under 35 U.S.C. 154(b) by 14 days.

(21) Appl. No.: 15/977,435

(22) Filed: May 11, 2018

(65) Prior Publication Data

US 2019/0346869 A1 Nov. 14, 2019

(51) Int. Cl.
*G05F 1/575* (2006.01)
*G05F 1/59* (2006.01)

(52) U.S. Cl.
CPC ..... *G05F 1/575* (2013.01); *G05F 1/59* (2013.01)

(58) Field of Classification Search
CPC . G05F 1/575; G05F 1/59; G05F 1/465; G05F 1/56; G05F 1/614
See application file for complete search history.

(56) References Cited

U.S. PATENT DOCUMENTS 10,250,139 B2 * 4/2019 Wan ..... H02M 1/08

* cited by examiner

*Primary Examiner* — Jung Kim

(57) ABSTRACT

A voltage regulator operable to selectively supply an extended range of regulated voltages by using multiple levels of unregulated voltages and a single amplifier. The voltage regulator is coupled to a plurality of passing elements in parallel via enabling switches. Each passing element is configured to receive a respective level of unregulated voltage and, when enabled, can pass current to the voltage regulator and thereby induce a corresponding level of regulated voltage at the output terminal of the voltage regulator. To output a specific regulated voltage, the voltage regulator can operate in a single passing mode in which only the passing element receiving the corresponding unregulated voltage is enabled to pass current. Alternatively, in a parallel passing mode, two or more passing elements receiving different levels of unregulated voltages can be enabled to pass current.

15 Claims, 4 Drawing Sheets

ON-CHIP VOLTAGE REGULATOR PROVIDING EXTENDED RANGE OF VOLTAGE SUPPLIES

TECHNICAL FIELD

The present disclosure relates generally to the field of integrated circuits, more specifically, to the field of power supply mechanisms in integrated circuits.

BACKGROUND OF THE INVENTION

Voltage regulators are widely used circuitry in any integrated circuit (or chip). When an external power is input to an integrated circuit, its characteristics are typically unstable, for example having an unpredictable voltage level or a high level of noise because of interference from the surrounding environment. An on-chip voltage regulator is used to regulate the external power by removing fluctuation and noise, thereby providing a regulated stable voltage to the other on-chip circuits that use the voltage. That is, the voltage regulator operates to isolate the on-chip circuits from the fluctuation and noise in the external power.

FIG. 1 illustrates the configuration of a voltage regulator 100 in accordance with the prior art. The voltage regulator 100 includes an error amplifier 101 and a pass transistor 102 which serves as a passing element to pass current from an unregulated voltage VDD_RAW1 to the voltage regulator output 104. The voltage regulator 100 may further include a feedback network comprised of Rload1 and Rload2 103A, 103B for current limiting. The voltage across the Rload2 103B is the regulated output voltage VDD_REG 104 which is supplied to the application circuitry as well as to the amplifier 101 through a feedback path 105. Some implementations may have an Rload1=0. Alternatively, some implementations may have either Rload1=0 and omit Rload2.

During operation, the amplifier 101 compares the output of a reference voltage Vref to the output voltage VDD_REG supplied through the feedback path 105. The output of the error amplifier 101 is coupled to the gate node 106 of the NMOS pass transistor 102, the gate node being used as a control terminal of the pass transistor 102. The amplifier 101, the pass transistor 102 and the feedback load network including Rload1 and Rload2 103A and 103B form a feedback control loop acting to force the control terminal 106 of the pass transistor 102 to a voltage that can maintain a regulated voltage VDD_REG at the output terminal 104 of the voltage regulator 100.

In this configuration, the regulated voltage VDD_REG is required to be lower than the unregulated voltage VDD_RAW1 to provide the regulation and isolation between the VDD_REG and VDD_RAW1. Hence the voltage range that can be supplied by the voltage regulator is constrained by the VDD_RAW1 and the drain source voltage requirement of the pass transistor 102. For example, given the VDD_RAW1 equal to 1.0 V and a drain source voltage requirement of 0.15V, the output regulated voltage is limited to about 0.85V.

BRIEF DESCRIPTION OF THE DRAWINGS

Embodiments of the present invention will be better understood from a reading of the following detailed description, taken in conjunction with the accompanying figures, in which like reference characters designate like elements and in which.

SUMMARY OF THE INVENTION

Figure 1:
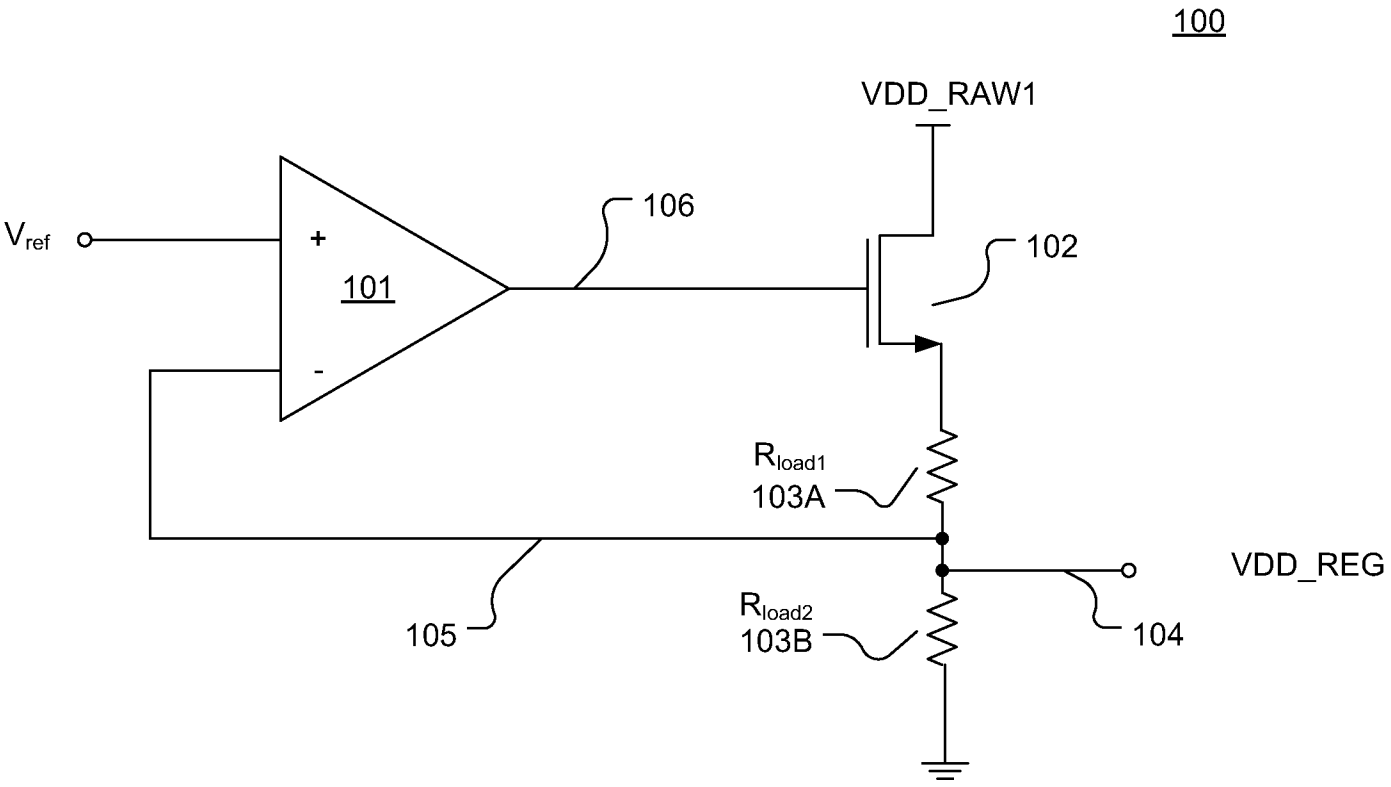
FIG. 1 (Prior Art)
FIG. 1 illustrates the configuration of a voltage regulator in accordance with the prior art.

Embodiments of the present disclosure are directed to an on-chip voltage regulation mechanism that allows an extended range of regulated voltages to be supplied from a voltage regulator based on different configurations which can factor in timing performance and power efficiency of use logic in the chip.

Embodiments of the present disclosure provide a voltage regulator that uses multiple passing elements to selectively supply current from different unregulated input voltages and correspondingly produces regulated voltages of different levels. The voltage regulator includes multiple passing elements coupled to an error amplifier in parallel and configured to receive different levels of unregulated input voltages (or "unregulated voltages" or "raw voltages" herein). Each passing element is operable to pass current from a respective unregulated voltage to the output terminal of the voltage regulator by the control of an enabling switch. The enabling switch is coupled between the control terminal of the passing element and the output of an amplifier. By control of the control logic, the enabling switches can be selectively turned on and off depending on the configurations and operation modes, and accordingly the passing elements can be selected to pass current to the voltage regulator.

More specifically, in a single passing mode, only one enabling switch is turned on and therefore a single passing element operates to pass the received raw voltage to the output terminal of the voltage regulator. In a parallel passing mode, multiple enabling switches can be turned on simultaneously and therefore multiple passing elements can operate in parallel to supply current to the output terminal of the voltage regulator. If the regulated voltage becomes greater than one or more of the unregulated voltages, the associated one or more passing elements may cease to pass current, and only one passing element that receives the highest RAW voltage remains active to pass current to the regulator output.

By using multiple passing elements to respectively pass current from multiples of unregulated voltages, the voltage regulator can provide regulated voltages of varying levels and in an extended range. An unregulated voltage can be selected by using the control logic to turn on and off the enabling switches. The control logic can be programmed or otherwise configured based on particular needs of the use logic that uses the regulated power on the chip, for example based on voltage limit, processing performance and power consumption considerations of the use logic. Furthermore, power consumption, as dictated by the current consumption multiplied by the level of the unregulated supply, is only increased when the higher unregulated supply is selected and decreased when the lower unregulated supply is selected. Thus power consumption can be controlled and is only increased when required. In this configuration, the voltage regulator output can be flexibly controlled and suited to various aspects of the use logic needs and performance.

The foregoing is a summary and thus contains, by necessity, simplifications, generalizations, and omissions of detail; consequently, those skilled in the art will appreciate that the summary is illustrative only and is not intended to be in any way limiting. Other aspects, inventive features, and advantages of the present invention, as defined solely by the claims, will become apparent in the non-limiting detailed description set forth below.

DETAILED DESCRIPTION

Reference will now be made in detail to the preferred embodiments of the present invention, examples of which are illustrated in the accompanying drawings. While the invention will be described in conjunction with the preferred embodiments, it will be understood that they are not intended to limit the invention to these embodiments. On the contrary, the invention is intended to cover alternatives, modifications, and equivalents which may be included within the spirit and scope of the invention as defined by the appended claims. Furthermore, in the following detailed description of embodiments of the present invention, numerous specific details are set forth in order to provide a thorough understanding of the present invention. However, it will be recognized by one of ordinary skill in the art that the present invention may be practiced without these specific details. In other instances, well-known methods, procedures, components, and circuits have not been described in detail so as not to unnecessarily obscure aspects of the embodiments of the present invention. Although a method may be depicted as a sequence of numbered steps for clarity, the numbering does not necessarily dictate the order of the steps. It should be understood that some of the steps may be skipped, performed in parallel, or performed without the requirement of maintaining a strict order of sequence. The drawings showing embodiments of the invention are semi-diagrammatic and not to scale and, particularly, some of the dimensions are for the clarity of presentation and are shown exaggerated in the Figures. Similarly, although the views in the drawings for the ease of description generally show similar orientations, this depiction in the Figures is arbitrary for the most part. Generally, the invention can be operated in any orientation.

On-Chip Voltage Regulator Providing Extended Range of Voltage Supplies

Embodiments of the present disclosure provide a voltage regulator operable to supply an extended range of regulated voltages by using a single amplifier and by selectively drawing current from multiple unregulated voltage sources. The voltage regulator is coupled to a plurality of passing elements in parallel via enabling switches. Each passing element is configured to receive a respective level of unregulated voltage and, when enabled, can pass current to the voltage regulator and thereby induce a corresponding regulated voltage at the output terminal of the voltage regulator. To output a specific regulated voltage, the voltage regulator can operate in a single passing mode in which only the passing element receiving the corresponding unregulated voltage is enabled to pass current. Alternatively, in a parallel passing mode, two or more passing elements receiving different levels of unregulated voltages can be enabled to pass current.

Even though embodiments are described by referring input voltages to a voltage regulator as "unregulated voltage" or "raw voltage," the input voltages may have been subject to a form of regulation or processing from a power source. For example, an output voltage from a battery may be supplied to an off-chip or on-chip pre-regulator, or any other suitable circuits, before being input to the on-chip voltage regulator. The present disclosure is not limited to any specific type of power sources or voltage sources that can supply an unregulated voltage to a voltage regulator according to embodiments of the present disclosure.

It will be appreciated that the present disclosure is not limited to any specific voltage levels of the unregulated or regulated voltages configured for a voltage regulator. Nor is it limited to any specific number of passing elements or number of different unregulated or regulated voltage levels configured for a voltage regulator.

Figure 2:
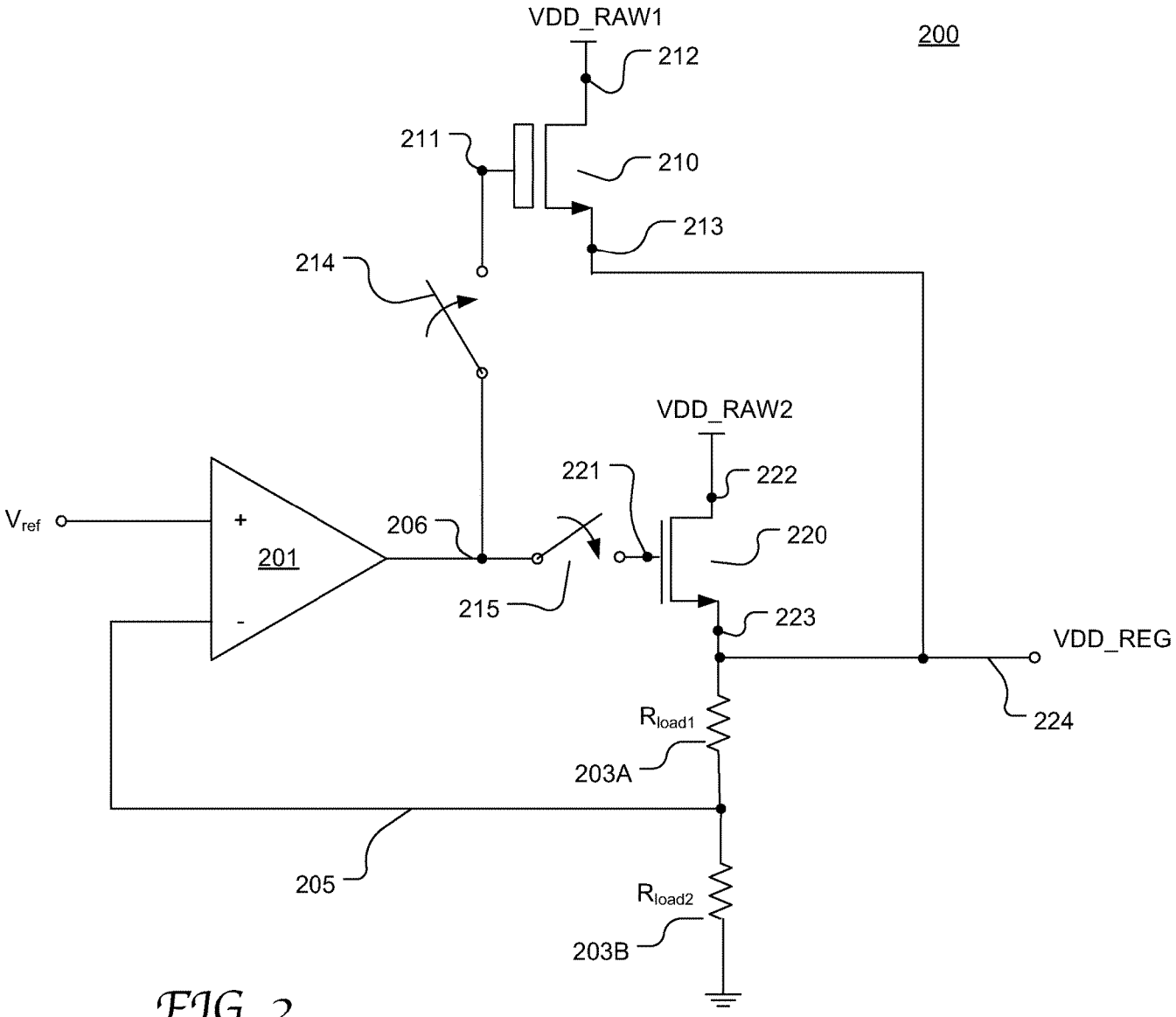
FIG. 2 illustrates the configuration of an exemplary voltage regulator capable of supplying an extended range of regulated voltages by selectively using current supplied from multiple unregulated voltages in accordance with an embodiment of the present disclosure.

FIG. 2 illustrates the configuration of an exemplary voltage regulator 200 capable of supplying an extended range of regulated voltages by selectively drawing current supplied from multiple unregulated voltages in accordance with an embodiment of the present disclosure. In a simplified form, the voltage regulator 200 includes an error amplifier 201, two passing elements 210 and 220 and two enabling switches 214 and 215. The amplifier 201 has one input coupled to a reference voltage $V_{ref}$ and the other input coupled to the voltage regulator output terminal 224 via a feedback path 205. The reference voltage Vref is supplied by a reference voltage source and is adjustable based on the intended output VDD_REG.

In the example, the pass transistors 210 and 220 each include an NMOS transistor and are configured to receive unregulated voltage VDD_RAW1 and VDD_RAW2 at the drain nodes 212 and 222, respectively. Each pass transistor 210 or 220 has the source node 213 or 223 coupled to the output terminal 224 of the voltage regulator as well as the feedback network Rload1 and Rload2 203A and 203B. The gate nodes 211 and 221 of the pass transistors 210 and 220 are selectively coupled to the output 206 of the amplifier 201 via respective enabling switches 214 and 215. When an enabling switch 214 or 215 is enabled, e.g., by control of control logic as described in greater detail below, the associated pass transistor 210 or 220 operates to pass current from the unregulated voltage VDD_RAW1 or VDD_RAW2 to the voltage regulator 200. The current flows through the feedback network Rload1 and Rload2 203A and 203B, resulting in the regulated voltage VDD_REG. The VDD_REG is then supplied to a corresponding voltage rail on the chip and further supplied to use logic that uses the VDD_REG.

The amplifier 201 operates to compare the Vref to a sample of the output voltage VDD_REG and produces an output at 206. The amplifier output controls the control terminal of the pass transistor 210 or 220, in this example the gate node 211 or 221. The amplifier 201, the pass transistor 210 or 220 and the feedback network Rload1 and Rload2 203A and 203B form a feedback control loop acting to force the control terminal 211 or 221 of the pass transistor 210 or 220 to a value that can maintain the regulated voltage VDD_REG at the regulated output terminal 224 of the voltage regulator 200.

Given an intended VDD_REG, the two pass transistors 210 and 220 may be activated individually in a single passing mode or in parallel in a parallel passing mode. In a single passing mode, only one enabling switch is enabled and thus only one pass transistor passes current to the voltage regulator. For example, the VDD_RAW1 equals 1.8 V and VDD_RAW2 equals 1.0 V. During an operation in which an intended VDD_REG is greater than 1 V (e.g., 1.5 V), the Vref is adjusted to the intended VDD_REG level and VDD_RAW1 (1.8 V) is selected to pass current because the output VDD_REG is expected to be lower than the supplying unregulated voltage VDD_RAW1. Thus, the enabling switch 214 can be turned on to couple the gate node 211 of pass transistor 220 to the amplifier output terminal 206.

On the other hand, if the intended VDD_REG is lower than 1 V (e.g., 0.85 V), the Vref is adjusted to the intended VDD_REG level, and VDD_RAW2 (1.0 V) can be selected to supply current. Thus, the enabling switch 215 is turned on to couple the gate node 221 of pass transistor 220 to the amplifier output terminal 206. In this case, selecting VDD_RAW1 (1.8V) to pass current instead can also produce the intended VDD_REG, but would cause a higher overall power consumption.

Selection of an intended VDD_REG can be made based on the specific design of the use logic circuits by taking into consideration several factors, such as processing speed, timing performance, power consumption, fabrication related voltage limit etc. Using a higher VDD_REG may enhance processing performance of a use circuit but may undesirably lead to higher power consumption. According to embodiments of the present disclosure, the voltage regulator provides options of different regulated voltage levels and so advantageously offers flexibility to select a voltage level that is customized to a use circuit in a certain scenario. For example, different VDD_REGs may be used for an active mode and a power saving mode of the circuit, respectively. This discussion is merely exemplary; it will be appreciated that the present disclosure is not limited to any specific algorithm, method, metrics, or factors used to select an intended VDD_REG from the multiple options provided by the voltage regulator.

According to embodiments of the present disclosure, the voltage regulator may operate in a parallel passing mode. For example, given an intended VDD_REG higher than a regulated voltage that the VDD_RAW2 (1.0) alone can induce, e.g., between 0.85V and 1.0V, the two enabling switches 214 and 215 can be enabled simultaneously. In response, the pass transistors 210 and 220 operate to pass current concurrently to the voltage regulator output.

By using multiple passing elements to respectively pass current from multiples unregulated voltages, the voltage regulator can provide regulated voltages of varying levels and in an extended range. A regulated voltage level can be selected by using the control logic to turn on and off the enabling switches. The control logic can be programmed or otherwise configured based on particular needs of the use logic that uses the regulated power on the chip, for example based on voltage limit, processing performance and power consumption considerations of the use logic. Thus, this advantageously offers flexibility to provide a selected regulated voltage level from multiple options and thereby enhances use logic performance in various aspects.

Further, in a parallel passing mode, the voltage regulator allows power sources of different raw voltages to supply current concurrently.

The present disclosure is not limited to any specific structures or configurations used to implement any of the passing elements, the feedback load, the amplifier or the enabling switches. The components shown in FIG. 2 can be implemented in any suitable manner that is well known in the art. For example, a plurality of pass transistors in a voltage regulator may include PMOS transistors, CMOS transistors, NMOS transistors, thin-oxide transistors, thick-oxide transistors, or a combination thereof. In the illustrated example, the pass transistor 210 is implemented using a thick-oxide transistor due to the relatively high VDD_RAW2 (1.8 V) it incurs, while the pass transistor 220 is implemented using a thin-oxide transistor as it only incurs a relatively low VDD_RAW (1.0 V). The enabling switches may be implemented by using transistors as well.

Figure 3:
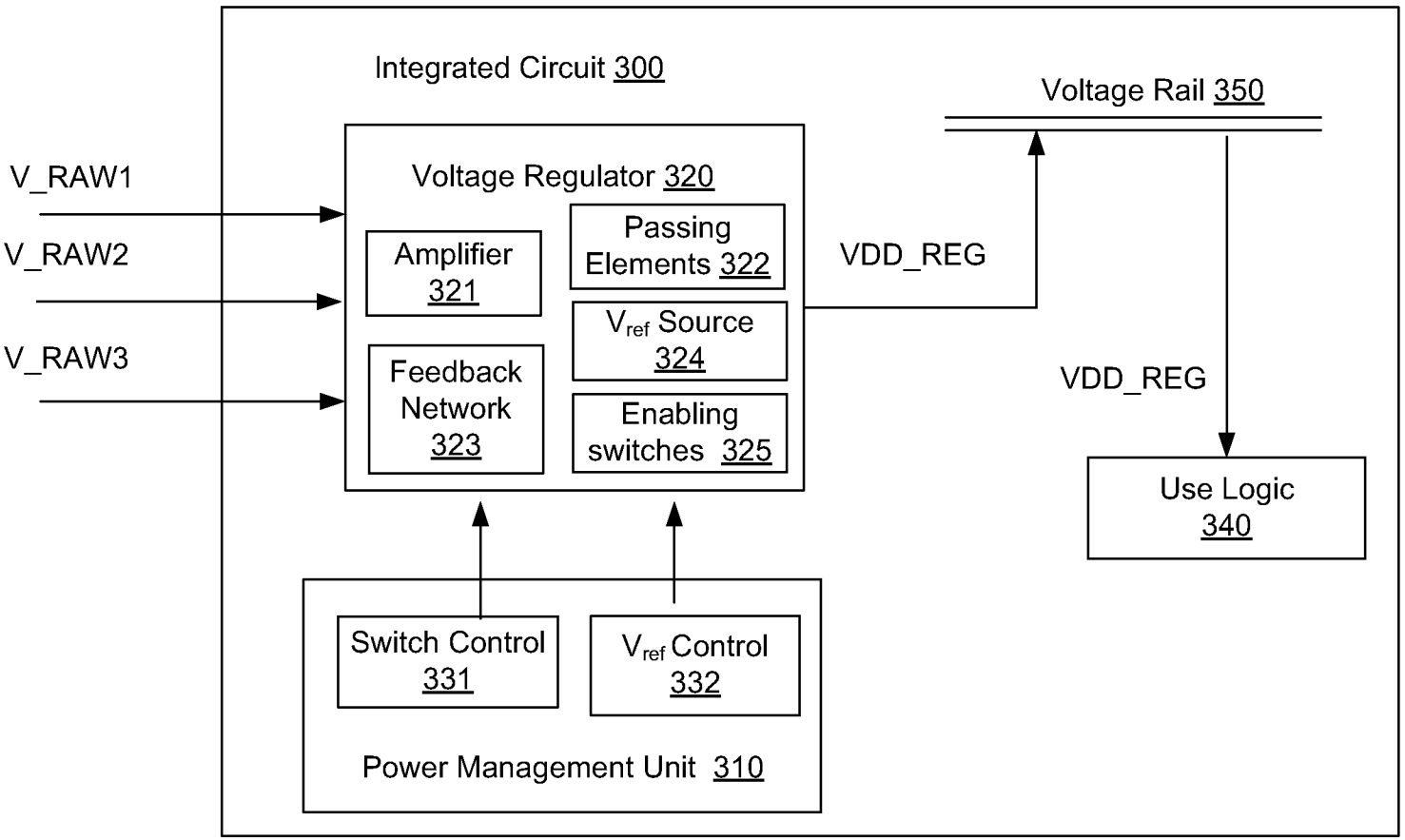
FIG. 3 is a block diagram illustrating an exemplary integrated circuit including a voltage regulator configured to supply an extended range of regulated voltages in accordance with an embodiment of the present disclosure.

FIG. 3 is a block diagram illustrating an exemplary integrated circuit 300 including a voltage regulator 320 configured to supply an extended range of regulated voltages in accordance with an embodiment of the present disclosure. The integrated circuit 300 includes a voltage regulator 320, a power management unit (PMU) 310, a voltage rail 350 and use logic 340 including circuits that use the regulated voltages output from the voltage regulator 320.

In this example, the voltage regulator 320 is configured to receive 3 unregulated voltages (VDD_RAW1, VDD_RAW2 and VDD_RAW2) which supply current individually in a single passing mode or concurrently in a parallel passing mode to the voltage regulator for generating a specific regulated voltage. The voltage regulator 320 includes an error amplifier 321 and a plurality of passing elements 322 respectively operable to pass current from the 3 unregulated voltages to the voltage regulator 320. The voltage regulator 320 further includes a feedback network 323, an adjustable Vref source 324 for supplying a reference voltage to the amplifier 321, and a plurality of enabling switches 325 for enabling the selected passing element(s) for passing current. The passing elements 322 may be implemented using passing transistors or any other passing elements that are well known in the art. The feedback network 323 may be implemented using resistive and capacitive loads or any other suitable load used in a voltage regulator that is well known in the art.

The PMU 310 includes control logic that controls the operations of the voltage regulator 320. More specifically, the PMU 310 includes switch control logic 331 configured to generate control signals to selectively turn on/off the switches 325 based on an intended regulated voltage (VDD_REG) and an operation mode, e.g., a single passing mode or a parallel passing mode. For example, the switch control logic 331 may select a VDD_REG and a VDD_RAW and accordingly generate a switch control signal by executing a computation algorithm that integrates a set of variables related to the use logic circuitry, such as processing speed, timing performance, power consumption, fabrication related voltage limit, operational status (power saving status or active status), and etc. The PMU 310 further includes a Vref control logic 332 for determining a Vref level to be applied to the amplifier 321 and thereby adjusting the output of the Vref source 324. It will be appreciated that the PMU 310 may include a wide range of other components and is configured for various functions that are well known in the art, such as battery charging, power source selection, voltage scaling, power sequencing, and etc.

The voltage regulator 320 can output a VDD_REG to a corresponding voltage rail 350 which transports the voltage to the use logic 340. The present disclosure can be practiced to supply voltages to any suitable functional modules or any suitable type of circuits on a chip, such as core domain circuits, Input/Output domain circuits, network circuits, microcontrollers, processors, transceivers, analog-digital-converts, and so on.

Figure 4:
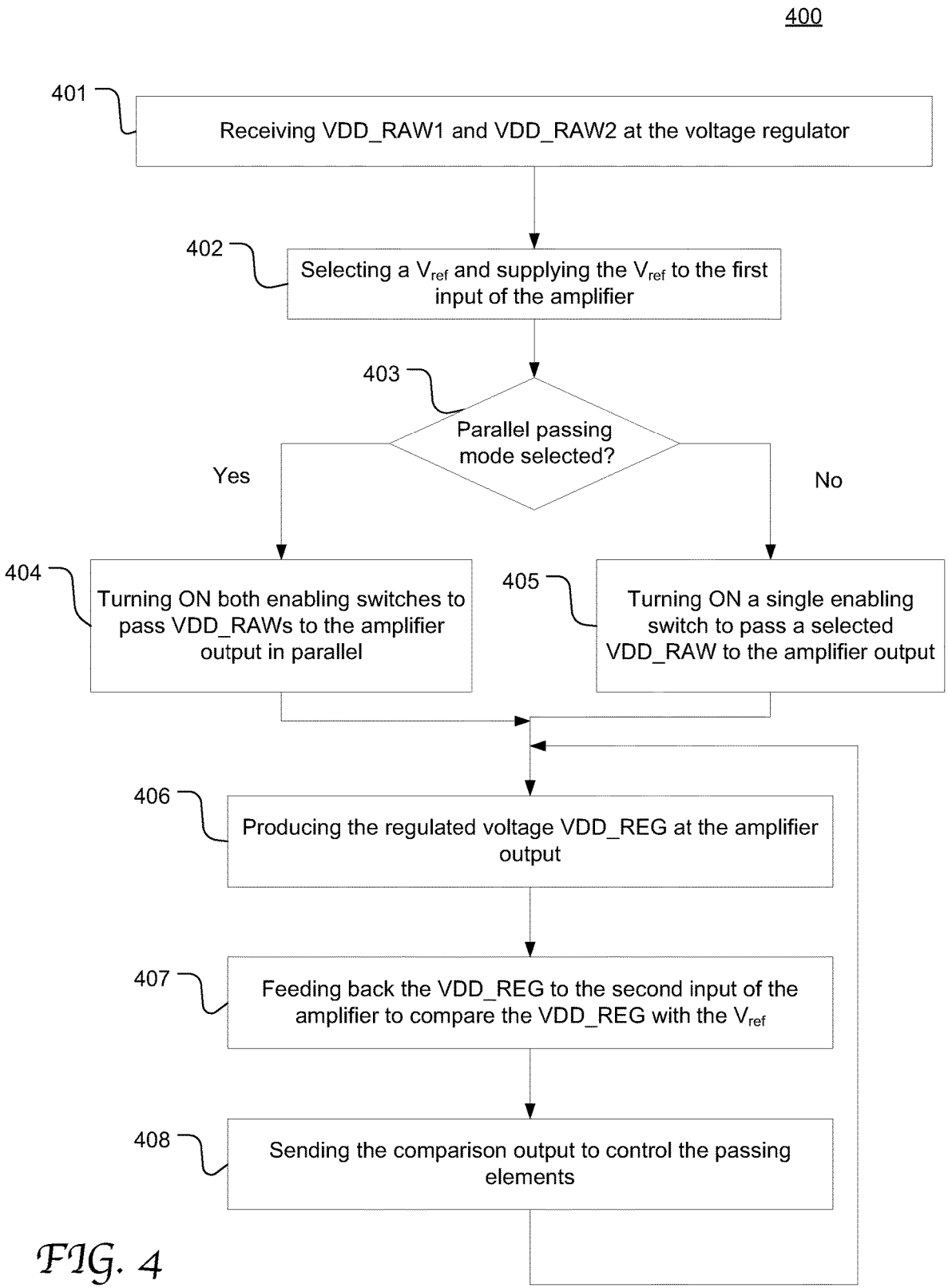
FIG. 4 is a flow chart depicting an exemplary process of generating a regulated voltage by selectively passing current from multiple unregulated voltages in accordance with an embodiment of the present disclosure.

FIG. 4 is a flow chart depicting an exemplary process 400 of generating a regulated voltage VDD_REG in accordance with an embodiment of the present disclosure. Process 400 may be performed by the voltage regulator 200 shown in FIG. 2 or the voltage regulator 320 in FIG. 3, or any other suitable voltage regulator circuits. At 401, unregulated voltages VDD_RAW1 and VDD_RAW2 are received at the voltage regulator input, particularly at specific terminals of the two passing elements. At 402, a reference voltage Vref is selected based on the intended VDD_REG and supplied to the first input of the amplifier. At 403, it is determined if a parallel passing mode is selected. If no, it means a single passing mode is selected, and so a single enabling switch is activated such that the associated source of the selected VDD_RAW passes current to the voltage regulator, e.g., to the amplifier output terminal as shown in FIG. 2. However, if a parallel passing mode is selected as determined at 403, both enabling switches are activated (at 404) such that the sources of both VDD_RAW1 and VDD_RAW2 start to pass current to the voltage regulator. At 406, a regulated voltage VDD_REG is produced at the amplifier output terminal. At 407, the VDD_REG output is supplied back to the second input of the amplifier and compared with the reference voltage Vref. At 408, the comparison result output from the amplifier is sent to the control terminals of the passing elements to control current passing. The foregoing 406-408 is repeated and performed by the feedback loop during the voltage regulation process.

Although certain preferred embodiments and methods have been disclosed herein, it will be apparent from the foregoing disclosure to those skilled in the art that variations and modifications of such embodiments and methods may be made without departing from the spirit and scope of the invention. It is intended that the invention shall be limited only to the extent required by the appended claims and the rules and principles of applicable law.

What is claimed is:

1. An integrated circuit comprising:

a voltage regulator comprising:

an amplifier comprising: a first input coupled to a reference voltage; a second input; and an output; and a plurality of pass transistors configured to receive a plurality of raw voltages of different levels, respectively, wherein each pass transistor comprises:

a first terminal configured to receive a respective raw voltage of said plurality of raw voltages;

a second terminal selectively coupled to said output of said amplifier via a respective enabling switch; and a third terminal coupled to said second input of said amplifier and an output terminal of said voltage regulator, wherein said output terminal of said voltage regulator is configured to output a regulated voltage; and use logic coupled to said voltage regulator and configured to receive said regulated voltage.

2. The integrated circuit as described in claim 1, wherein said pass transistor is a NMOS transistor.

3. The integrated circuit as described in claim 2, wherein: said first terminal is a drain node; said second terminal is a gate node; and said third terminal is a source node.

4. The integrated circuit as described in claim 1, wherein said plurality of pass transistors comprise a thin gate oxide transistor and a thick gate oxide transistor.

5. The integrated circuit as described in claim 1 further comprising control logic configured to:

select a raw voltage from said a plurality of raw voltages; and switch on an enabling switch coupled to a corresponding pass transistor that is configured to receive said raw voltage while enabling switches coupled to remaining pass transistors of said plurality of pass transistors are OFF.

6. The integrated circuit as described in claim 1 further comprising control logic configured to:

select a set of raw voltages from said a plurality of raw voltages; and simultaneously switch on enabling switches coupled to a set of pass transistors that are configured to receive said set of raw voltages.

7. The integrated circuit as described in claim 6, wherein said set of raw voltages comprises a raw voltage higher than said regulated voltage and another raw voltage lower than said regulated voltage.

8. The integrated circuit as described in claim 1, wherein said plurality of raw voltages are generated by an external source disposed external to said integrated circuit.

9. An integrated circuit comprising:

a voltage regulator comprising an amplifier selectively coupled to a plurality of passing elements in parallel, wherein said plurality of passing elements are configured to receive different raw voltages, respectively, wherein said voltage regulator is configured to generate a regulated voltage responsive to one or more of said plurality of passing elements passing current from one or more sources of said different raw voltages; and use logic coupled to said voltage regulator and configured to receive said regulated voltage.

10. The integrated circuit as described in claim 9, wherein said amplifier comprises: a first input coupled to a reference voltage; a second input; and an output, wherein each passing element of said plurality of passing elements comprises a pass transistor comprising:

a first terminal configured to receive a respective raw voltage;

a second terminal selectively coupled to said output of said amplifier via a respective enabling switch; and a third terminal coupled to said second input of said amplifier and configured to output a regulated voltage.

11. The integrated circuit as described in claim 9, wherein said pass transistor is an NMOS or PMOS transistor, and wherein: said first terminal is a drain node; said second terminal is a gate node; and said third terminal is a source node.

12. The integrated circuit as described in claim 9, wherein said plurality of passing elements comprise:

a thin gate oxide transistor configured to receive a first raw voltage, and a thick gate oxide transistor configured to receive a second raw voltage that is higher than said first raw voltage.

13. The integrated circuit as described in claim 9 further comprising control logic configured to:

select a raw voltage from said different raw voltages; and switch on an enabling switch coupled to a corresponding passing element that is configured to receive said raw voltage while enabling switches coupled to remaining passing elements of said plurality of passing elements are OFF.

14. The integrated circuit as described in claim 13, wherein said control logic is further configured to:

select a set of raw voltages from said different raw voltages; and simultaneously switch on enabling switches coupled to a set of passing elements that are configured to receive said set of raw voltages.

15. The integrated circuit as described in claim 14, wherein said set of raw voltages comprises a raw voltage higher than said regulated voltage and another raw voltage lower than said regulated voltage.

* * * * *